US009141043B2

(12) United States Patent
Saiki

(10) Patent No.: US 9,141,043 B2
(45) Date of Patent: Sep. 22, 2015

(54) TRANSPORT DEVICE, FIXING DEVICE, AND IMAGE FORMING APPARATUS

(71) Applicant: FUJI XEROX CO., LTD., Tokyo (JP)

(72) Inventor: Mikio Saiki, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/012,056

(22) Filed: Aug. 28, 2013

(65) Prior Publication Data

US 2014/0270871 A1 Sep. 18, 2014

(30) Foreign Application Priority Data

Mar. 12, 2013 (JP) ..... 2013-049180

(51) Int. Cl.
*G03G 15/20* (2006.01)
*G03G 15/00* (2006.01)
*G03G 15/16* (2006.01)

(52) U.S. Cl.
CPC ..... *G03G 15/2017* (2013.01); *G03G 15/1615* (2013.01); *G03G 15/2064* (2013.01); *G03G 15/2085* (2013.01); *G03G 15/755* (2013.01); *G03G 15/2028* (2013.01); *G03G 2215/00143* (2013.01); *G03G 2215/2016* (2013.01); *G03G 2215/2032* (2013.01)

(58) Field of Classification Search
CPC ..... G03G 15/755; G03G 15/1615; G03G 15/2064; G03G 2215/00143; G03G 2215/2016; G03G 15/2017; G03G 15/2028; G03G 15/2085; G03G 2215/2032
USPC ..... 399/329
See application file for complete search history.

(56) References Cited

U.S. PATENT DOCUMENTS

| | | | | |
|---|---|---|---|---|
| 5,991,575 | A * | 11/1999 | Okiyama et al. | 399/165 |
| 6,185,394 | B1 * | 2/2001 | Lee | 399/116 |
| 6,249,662 | B1 * | 6/2001 | Lee | 399/165 |
| 2013/0064581 | A1 * | 3/2013 | Okamoto et al. | 399/302 |

FOREIGN PATENT DOCUMENTS

| | | | |
|---|---|---|---|
| JP | A-7-97089 | | 4/1995 |
| JP | 2005017482 | A * | 1/2005 |
| JP | 2006133399 | A * | 5/2006 |
| JP | A-2006-225130 | | 8/2006 |
| JP | A-2006-267953 | | 10/2006 |

OTHER PUBLICATIONS

English Translation Yokota et al. (JP 2006133399), May 2006.*

* cited by examiner

*Primary Examiner* — Ryan Walsh
(74) *Attorney, Agent, or Firm* — Oliff PLC

(57) ABSTRACT

A transport device includes a belt-shaped member that is rotated so as to transport an object, a first support member that supports the belt-shaped member, an urging member extending in an axial direction of the first support member, and a conversion unit that converts a direction of an urging force of the urging member to a direction toward the belt-shaped member.

8 Claims, 9 Drawing Sheets

TRANSPORT DEVICE, FIXING DEVICE, AND IMAGE FORMING APPARATUS

CROSS-REFERENCE TO RELATED APPLICATIONS

This application is based on and claims priority under 35 USC 119 from Japanese Patent Application No. 2013-049180 filed Mar. 12, 2013.

BACKGROUND

Technical Field

The present invention relates to a transport device, a fixing device, and an image forming apparatus.

SUMMARY

According to an aspect of the invention, a transport device includes a belt-shaped member that is rotated so as to transport an object, a first support member that supports the belt-shaped member, an urging member extending in an axial direction of the first support member, and a conversion unit that converts a direction of an urging force of the urging member to a direction toward the belt-shaped member.

BRIEF DESCRIPTION OF THE DRAWINGS

Exemplary embodiments of the present invention will be described in detail based on the following figures, wherein.

DETAILED DESCRIPTION

Hereinafter, exemplary embodiments of the present invention will be described with reference to the drawings.

Figure 1:
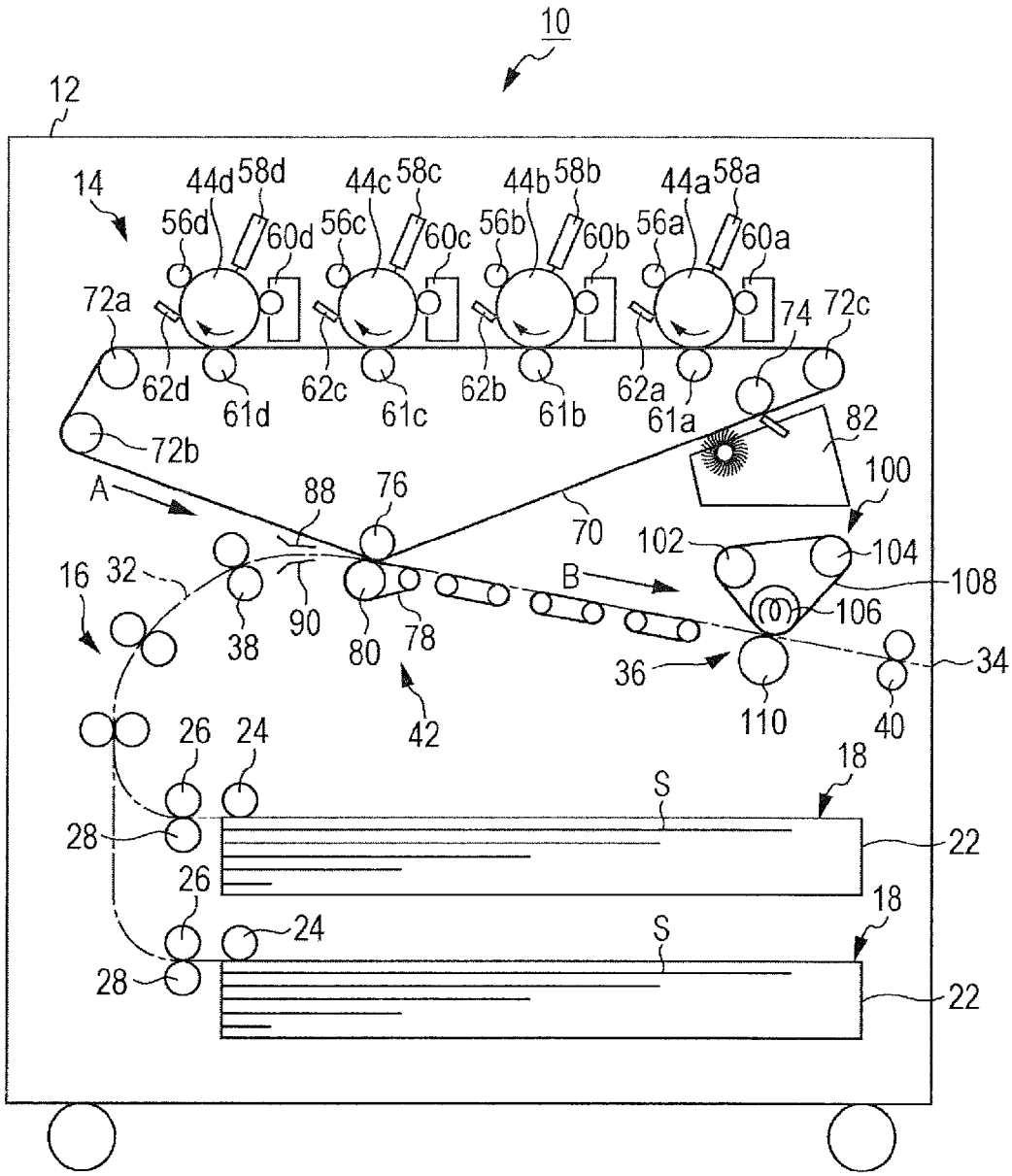
FIG. 1 is a schematic view of an image forming apparatus according to an exemplary embodiment of the present invention.

FIG. 1 is a schematic view of an image forming apparatus 10 according to an exemplary embodiment of the present invention. The image forming apparatus 10 includes an image forming apparatus body 12, an image forming unit 14 disposed in the image forming apparatus body 12, a transport unit 16 disposed below the image forming unit 14, and sheet feeders 18 disposed in a lower region in the image forming apparatus body 12 below the transport unit 16. The number of the sheet feeders 18 is, for example, two.

Each of the sheet feeders 18 includes a sheet feed cassette 22, in which a stack of sheets S, each of which is an example of an object, is stored. The sheets S may be any sheets made of any material. In the exemplary embodiments of the present invention, a recording sheet is used as a typical example. A pick-up roller 24 is disposed above an end of the sheet feed cassette 22. A pinch roller 26 and a transport roller 28 are disposed on the downstream side of the pick-up roller 24 in the sheet transport direction. The pick-up roller 24, the pinch roller 26, and the transport roller 28 may be included in the image forming apparatus body 12 or in the sheet feed cassette 22.

The transport unit 16 has a transport path 32, extending from the transport roller 28 to an outlet 34, along which the sheet S passes. The transport path 32 includes a portion that extends through a space near a side surface of the image forming apparatus body 12 (the left side surface in FIG. 1) from the sheet feeders 18 in a lower portion of the image forming apparatus body 12 and a portion that extends substantially horizontally to a fixing device 36 described below. Output rollers 40 are disposed near the outlet 34 of the transport path 32. The fixing device 36 is disposed on the upstream side of the output rollers 40 in the sheet transport direction. The fixing device 36 includes a pressing roller 110, which is an example of a pressing member, and a transport device 100. The transport device 100 includes a heating roller 106, which is an example of a heating member. A second-transfer device 42, which is an example of a transfer unit, is disposed on the upstream side of the fixing device 36. An upper chute 88 and a lower chute 90 described below, which are examples of a guiding unit, are disposed on the upstream side of the second-transfer device 42. Registration rollers 38 are disposed on the upstream side of the upper and lower chutes 88 and 90. The registration rollers 38, which temporarily stop a sheet that has been transported from one of the sheet feeders 18, is an example of a temporarily stopping member.

In the image forming apparatus 10 described above, sheets S are picked by the pick-up roller 24 from the sheet feed cassette 22 of one of the sheet feeders 18. The pinch roller 26 and the transport roller 28 separate the sheets S and feed only the uppermost one of the sheets S into the transport path 32. The registration rollers 38 temporarily stop the sheet S and then allow the sheet S to pass through a space between the upper and lower chutes 88 and 90 at an appropriate timing. While the sheet S passes through a nip between a second-transfer roller 80 and a backup roller 76, which are included in the second-transfer device 42, developer images are transferred to the sheet S. The fixing device 36 fixes the transferred developer images onto the sheet S. The output rollers 40 output the sheet S from the outlet 34.

The image forming unit 14 is, for example, an electrophotographic system. The image forming unit 14 includes four image carriers 44*a* to 44*d*, chargers 56*a* to 56*d*, exposure devices 58*a* to 58*d*, developing devices 60*a* to 60*d*, first-transfer rollers 61*a* to 61*d* (first-transfer devices), cleaning devices 62*a* to 62*d*, and the fixing device 36. The image carriers 44*a* to 44*d* each include a photoconductor. The chargers 56*a* to 56*d* include, for example, charging rollers and charge the image carriers 44*a* to 44*d*. The exposure devices 58*a* to 58*d* form latent images on the image carriers 44*a* to 44*d*, which have been charged by the chargers 56*a* to 56*d*. The developing devices 60*a* to 60*d* form developer images (visible images) from the latent images on the image carriers 44*a* to 44*d*, which have been formed by the exposure devices 58*a* to 58*d*. The first-transfer rollers 61*a* to 61*d* first-transfer the developer images, which have been formed by the developing devices 60*a* to 60*d*, to the sheet S. The cleaning devices 62*a* to 62*d* include, for example, blades and remove developer that remains on the image carriers 44*a* to 44*d*. The fixing device 36 fixes the developer images, which have been second-transferred by the second-transfer device 42, onto the sheet S.

An intermediate transfer belt 70, which is an example of a belt-shaped transport member, is looped over tension rollers 72*a* to 72*c*, a drive roller 74, and the backup roller 76. As the tension rollers 72*a* to 72*c*, the drive roller 74, and the backup roller 76 rotate, the intermediate transfer belt 70 rotates in the direction of arrow A and passes through spaces between the image carriers 44*a* to 44*d* and the first transfer rollers 61*a* to 61*d* while being in contact with surfaces of the image carriers 44*a* to 44*d*. The first transfer rollers 61*a* to 61*d* face the image carriers 44*a* to 44*d* with the intermediate transfer belt 70 therebetween in first-transfer regions. First transfer voltages are applied to the first-transfer regions, in which the image carriers 44*a* to 44*d* and the first transfer rollers 61*a* to 61*d* face each other.

The second-transfer device 42 includes the backup roller 76 and the second-transfer roller 80, which face each other with the intermediate transfer belt 70 and a second-transfer belt 78 therebetween. The sheet S passes through a space between the intermediate transfer belt 70 and the second-transfer roller 80 in the direction of arrow B while being in contact with a surface of the intermediate transfer belt 70. Subsequently, the sheet S passes through the fixing device 36. The second-transfer roller 80 faces the backup roller 76 with the intermediate transfer belt 70 and the second-transfer belt 78 therebetween in a second-transfer region. A second transfer voltage is applied to the second-transfer region, in which the second-transfer roller 80 and the backup roller 76 face each other. An intermediate transfer belt cleaning device 82 is disposed so as to be in contact with a portion of the intermediate transfer belt 70 from which the developer images have been transferred to the sheet S.

In the image forming apparatus 10, which is a full-color image forming apparatus having the structure described above, the image carrier 44*a* rotates in the direction of an arrow in FIG. 1, the charger 56*a* uniformly charges a surface of the image carrier 44*a*, and the exposure device 58*a* forms an electrostatic latent image of a first color by using a laser beam or the like. The developing device 60*a*, which contains a toner of the first color, develops the electrostatic latent image to form a toner image. Note that the developing devices 60*a* to 60*d* respectively contain color toners (such as yellow, magenta, cyan, and black toners) for forming electrostatic latent images.

When the toner image formed on the image carrier 44*a* passes through the first-transfer region, the first transfer roller 61*a* electrostatically transfers (first-transfers) the toner image to the intermediate transfer belt 70. After the first color toner image has been transferred to the intermediate transfer belt 70, the first-transfer rollers 61*b* to 61*d* successively transfer second color, third color, and fourth color toner images to the intermediate transfer belt 70. As a result, overlapping toner images, which represent a full color image, is obtained.

When the overlapping toner images on the intermediate transfer belt 70 pass through the second-transfer region, the overlapping toner images are electrostatically and simultaneously transferred to the sheet S. After the overlapping toner images have been transferred to the sheet S, the sheet S is transported to the fixing device 36, which heats and presses the sheet S to fix the overlapping toner images onto the sheet S. Then, the sheet S is output to the outside of the apparatus.

After the first-transfer operation has been finished, the cleaning devices 62*a* to 62*d* remove toners remaining on the image carriers 44*a* to 44*d*. After the second-transfer operation has been finished, the cleaning device 82 removes toners remaining on the intermediate transfer belt 70 to prepare for the next image forming process.

First Exemplary Embodiment

Figure 2:
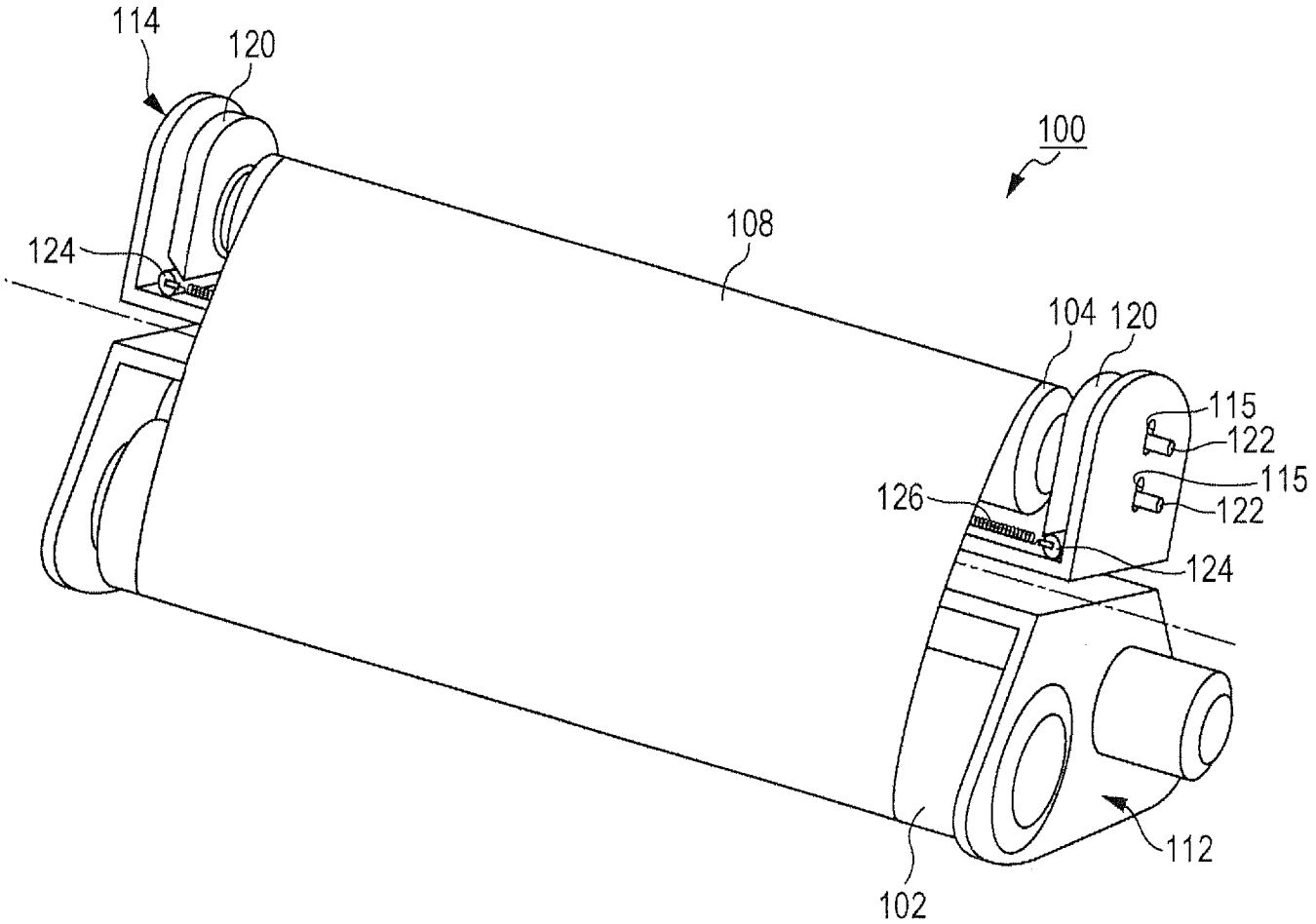
FIG. 2 is a perspective view of a transport device according to a first exemplary embodiment of the present invention.
Figure 3:
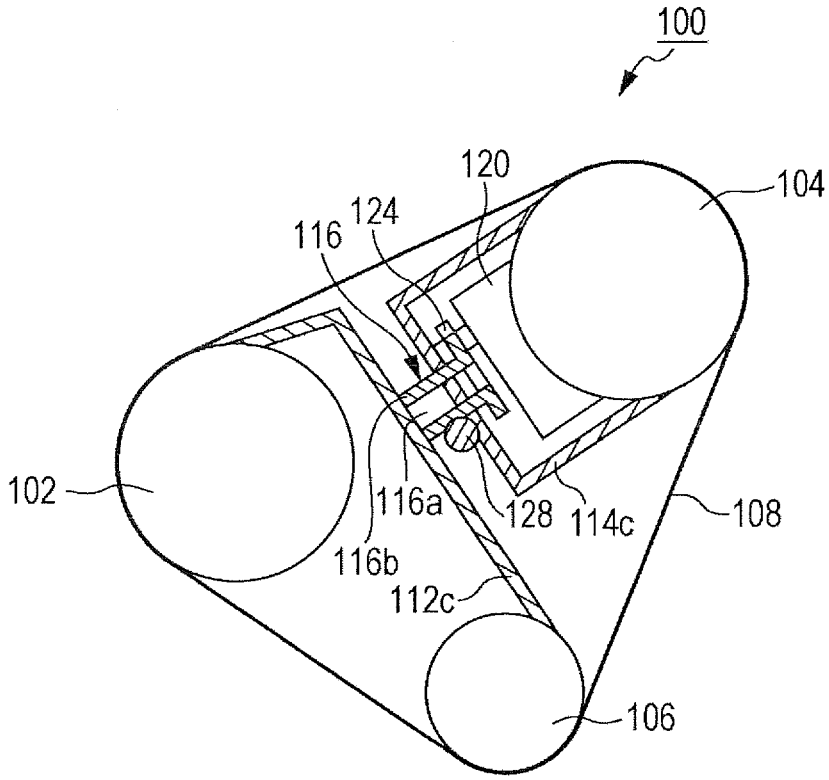
FIG. 3 is a cross-sectional view of the transport device according to the first exemplary embodiment.

FIG. 2 is a perspective view of the transport device 100, which transports the sheet S toward the outlet 34, according to a first exemplary embodiment of the present invention. FIG. 3 is a cross-sectional view of the transport device 100.

The transport device 100 includes a drive roller 102, which is an example of a first support member; a driven roller 104, which is an example of a second support member; and the heating roller 106.

A transport belt 108, which is an example of a belt-shaped member, is looped over and supported by the drive roller 102, the driven roller 104, and the heating roller 106.

The pressing roller 110 is disposed so as to face the heating roller 106 with the transport belt 108 therebetween.

As the drive roller 102, the driven roller 104, and the heating roller 106 rotate, the transport belt 108 rotates. Accordingly, the sheet S is transported toward the outlet 34 through a nip between the pressing roller 110 and the heating roller 106 of the fixing device 36.

Figure 4:
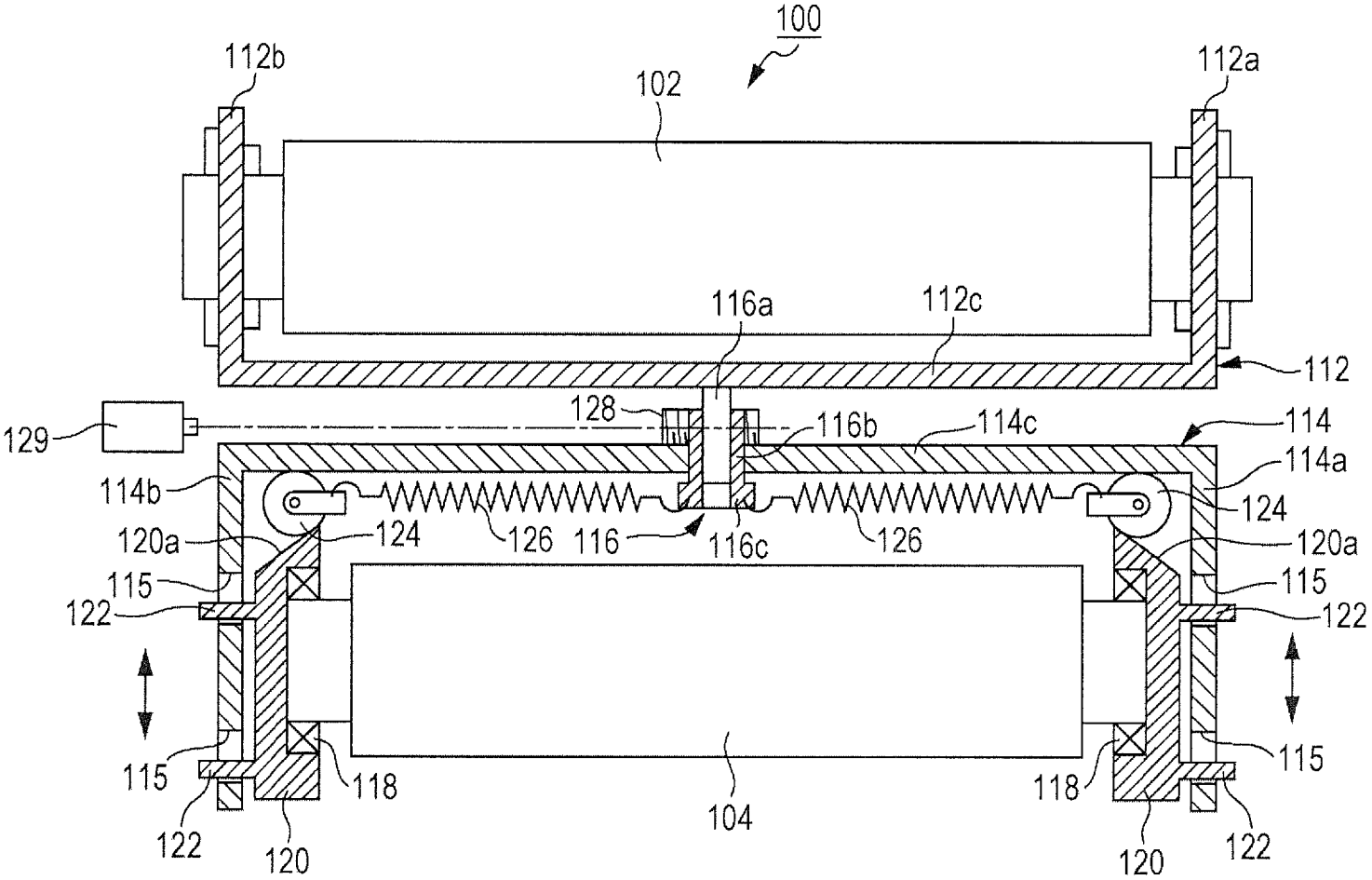
FIG. 4 illustrates the structure of the transport device according to the first exemplary embodiment.

FIG. 4 illustrates the structure of the transport device 100.

The drive roller 102 is rotatably supported by a first body 112. The driven roller 104 is supported by a second body 114 in such a way that the driven roller 104 is movable in a radial direction of the driven roller 104.

The first body 112 includes a horizontal plate 112*c* and a pair of side plates 112*a* and 112*b* connected to the horizontal plate 112*c*. The side plates 112*a* and 112*b* support both ends of the drive roller 102.

The second body 114 includes a horizontal plate 114*c* and a pair of side plates 114*a* and 114*b* connected to the horizontal plate 114*c*. The side plates 114*a* and 114*b* support both ends of the driven roller 104. Oblong holes 115 are formed in each of the side plates 114*a* and 114*b*. The number of the oblong holes 115 is, for example, two.

A shaft 116*a* is disposed at substantially the center of the first body 112 in the longitudinal direction. A bearing 116*b* is disposed at substantially the center of the second body 114 in the longitudinal direction. When the shaft 116*a* is inserted into the bearing 116*b*, a connection unit 116, which serves as a pivot, is formed. The connection unit 116 connects the first body 112 to the second body 114 in such a way that the first body 112 and the second body 114 are rotatable relative to each other. The connection unit 116 rotates about an axis that is located at substantially the center of the driven roller 104 in the axial direction, so that meandering of the transport belt 108 is prevented. A head 116*c* is attached to the bearing 116*b*.

Both ends of the driven roller 104 are rotatably attached to holders 120 through bearings 118. The holders 120 are examples of a holding unit. Two protrusions 122 are formed on a side of each of the holder 120 opposite to the side on which the driven roller 104 is attached. The driven roller 104 is mounted on the second body 114 by inserting the protrusions 122 into the oblong holes 115.

Side surfaces of the holders 120 facing the horizontal plate 114*c* (the drive roller 102) are inclined surfaces 120*a*. Each of the inclined surfaces 120*a* is inclined in such a way that a space between the inclined surface 120*a* and the horizontal plate 114*c* widens toward a corresponding one of the side plates 114*a* and 114*b*.

Figure 5:
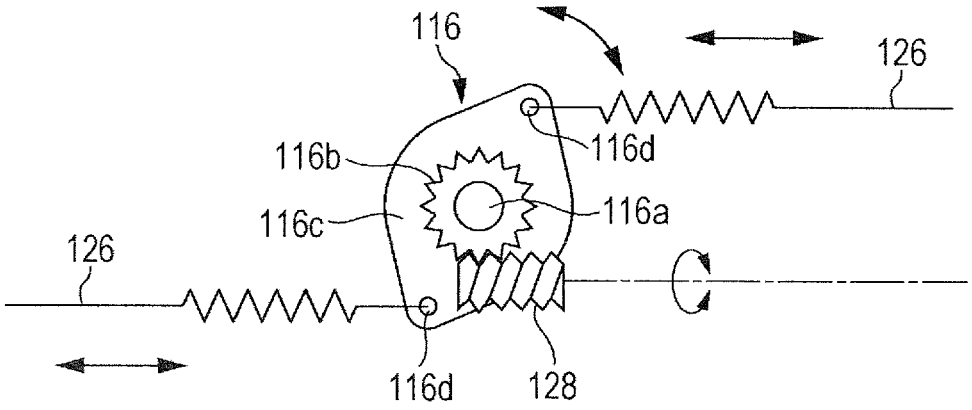
FIG. 5 is illustrates a region surrounding a connection unit of the transport device according to the first exemplary embodiment.

FIG. 5 illustrates a region surrounding the connection unit 116 of the transport device 100.

Two tension springs 126, which are examples of an urging member, are connected to the connection unit 116. As illustrated in FIG. 4, the tension springs 126 extend in the axial direction of the driven roller 104. To be specific, two holes 116*d* are formed in the head 116*c* of the connection unit 116 so as to be symmetric about the center of the connection unit 116. One end of each of the tension springs 126 is connected to a corresponding one of the holes 116*d*. The other end of each of the tension springs 126 is connected to a roller 124.

Each of the rollers 124 rolls along the horizontal plate 114*c* and a corresponding one of the inclined surfaces 120*a* in the axial direction of the driven roller 104. To be specific, due to the tensions of the tension springs 126, the rollers 124 roll along the horizontal plate 114*c* and the inclined surfaces 120*a* in the axial direction of the driven roller 104. As a result, the protrusions 122 of the holders 120 move in the oblong holes 115, and the driven roller 104 is moved in a radial direction of the driven roller 104. That is, an urging force in the axial direction of the driven roller 104 is converted into a force in the radial direction of the driven roller 104, so that a tension is applied to the transport belt 108 and a frictional force needed for correction of meandering of the transport belt 108 is generated. In the present exemplary embodiment, the rollers 124 and the inclined surfaces 120*a* of the holders 120 are examples of a conversion unit.

An adjuster 128 is connected to the connection unit 116.

To be specific, diagonal grooves are formed in the outer peripheral surface of the bearing 116*b* of the connection unit 116. The adjuster 128 meshes with the grooves of the bearing 116*b*. The adjuster 128 is, for example, a cylindrical worm gear. By rotating the adjuster 128, the connection unit 116 is rotated leftward or rightward, the tensions (urging forces) of the tension springs 126 are adjusted, and a frictional force needed for correction of meandering of the transport belt 108 is generated. To be specific, the tensions of the tension springs 126 may be decreased in order to facilitate replacement of the transport belt 108 and assembly of the transport device 100. On the other hand, the tensions of the tension springs 126 may be increased in order to facilitate attachment of the transport belt 108 and apply an appropriate tension to the transport belt 108.

The adjuster 128 may have a flexile structure including, for example, a joint for preventing meandering of the transport belt 108. A motor 129 may be connected to the adjuster 128 so that the adjuster 128 may automatically perform adjustment in accordance with meandering of the belt.

Comparative Example

Next, a transport device 200 according to a comparative example will be described in detail.

Figure 6:
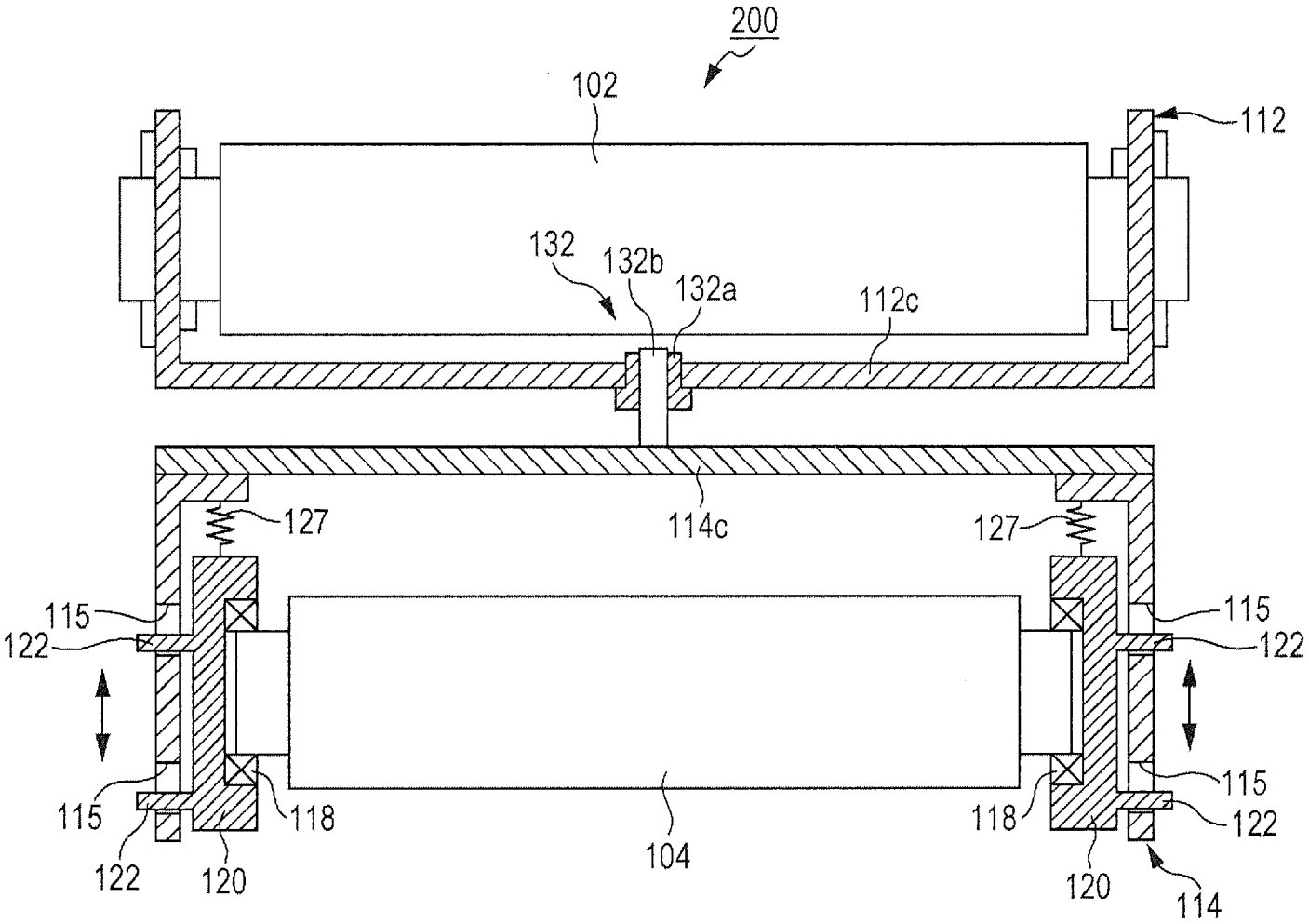
FIG. 6 illustrates the structure of the transport device according to a comparative example.
Figure 7:
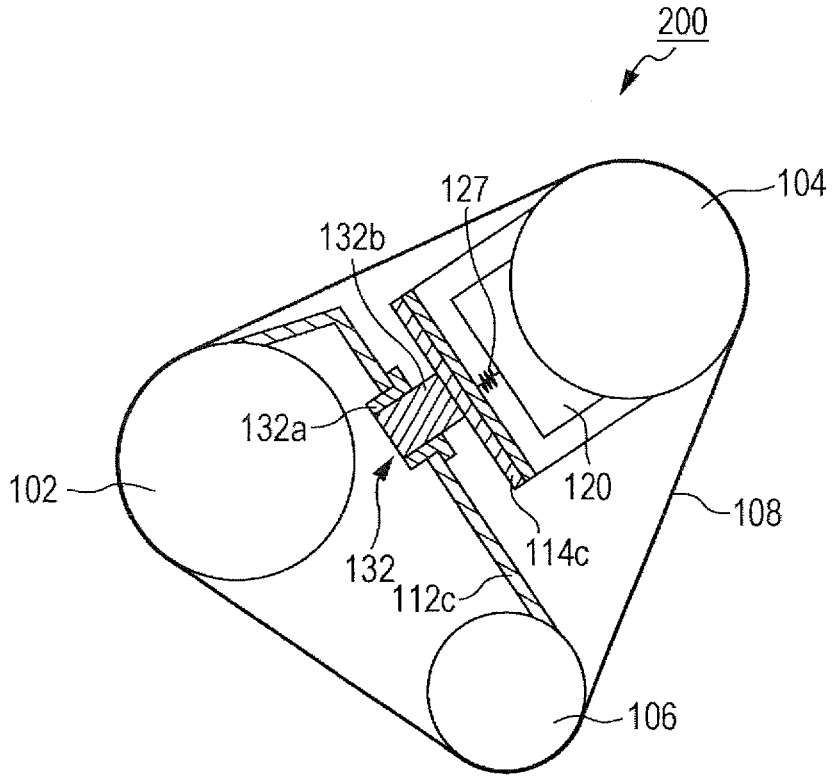
FIG. 7 is a cross-sectional view of the transport device according to the comparative example.

FIG. 6 is a top view illustrating the structure of the transport device 200 according to the comparative example. FIG. 7 is a cross-sectional view of the transport device 200.

Elements of the transport device 200 having structures the same as those of the transport device 100 according to the exemplary embodiment described above will be denoted by the same numerals and their descriptions will be omitted.

In the transport device 200 according to the comparative example, side surfaces of the holders 120 are substantially parallel to the horizontal plate 114*c*. A compression spring 127, which is an example of an urging member, is disposed on one of the side surfaces of each of the holders 120, which hold the driven roller 104. That is, the compression springs 127 extend from the horizontal plate 114*c* of the second body 114 in a radial direction of the driven roller 104.

A bearing 132*a* is disposed at substantially the center of the first body 112 in the longitudinal direction. A shaft 132*b* is disposed at substantially the center of the second body 114 in the longitudinal direction. When the shaft 132*b* is inserted into the bearing 132*a*, a connection unit 132, which serves as a pivot, is formed. The connection unit 132 connects the first body 112 to the second body 114 in such a way that the first body 112 and the second body 114 are rotatable relative to each other. The connection unit 132 rotates about an axis that is located at substantially the center of the driven roller 104 in the axial direction, so that meandering of the transport belt 108 is prevented.

However, the structure of the comparative example has the following problems. First, the size of the transport device 200 is large, because the compression springs 127 are disposed so as to extend in a radial direction of the driven roller 104 (a direction in which a tension is applied to the transport belt 108). Second, because it is necessary to use a spring having a relatively large spring constant as the urging member in order to apply a sufficiently high tension to the transport belt 108, it is difficult to sufficiently reduce the tension of the belt when replacing the belt, and therefore replacement of the transport belt 108 and assembly of the transport device 200 are difficult to perform.

In contrast, with the present exemplary embodiment, an urging force in the axial direction of the driven roller 104 is converted into a force in a direction toward the transport belt 108, so that the size of the transport device may be reduced and replacement of the belt and assembly of the transport device may be easily performed.

Next, other exemplary embodiments of the present invention will be described in detail.

Second Exemplary Embodiment

Figure 8:
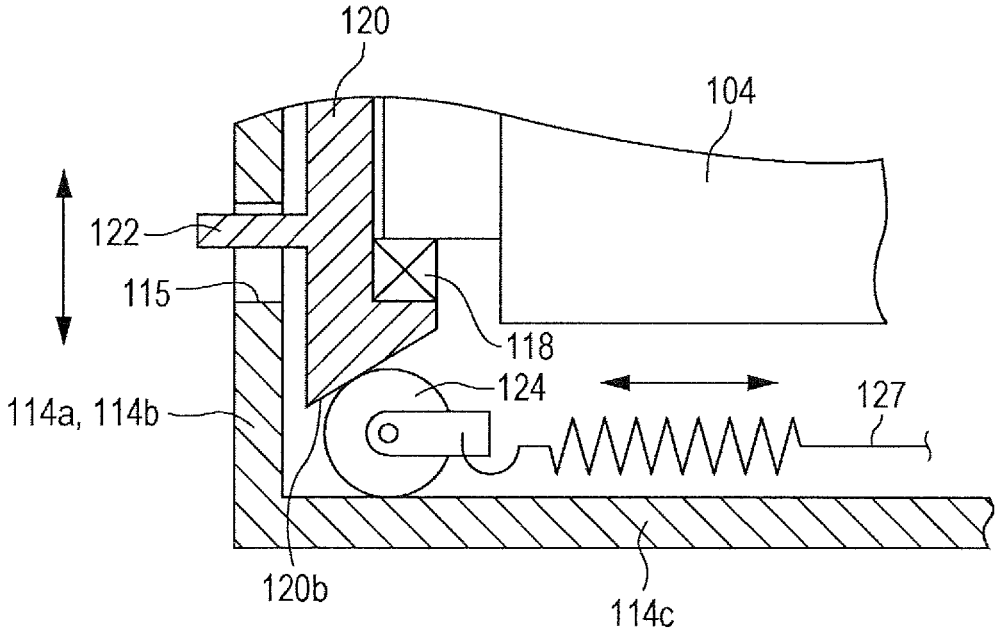
FIG. 8 illustrates a conversion unit according to a second exemplary embodiment of the present invention.

FIG. 8 illustrates a conversion unit of a transport device 100 according to a second exemplary embodiment of the present invention.

This conversion unit differs from the conversion unit of the first exemplary embodiment in the inclined surfaces of the holders 120 for supporting the driven roller 104.

That is, in the present exemplary embodiment, inclined surfaces 120*b* are formed on a side opposite to the side on which the inclined surfaces 120*a* (described above) are disposed. To be specific, the inclined surfaces 120*b*, which are side surfaces of the holders 120 facing the horizontal plate 114*c* (the drive roller 102), are each inclined in such a way that a space between the inclined surface 120*b* and the horizontal plate 114*c* narrows toward a corresponding one of the side plates 114*a* and 114*b*. Each of the rollers 124 rolls along the horizontal plate 114*c* and a corresponding one of the inclined surfaces 120*a*. Here, compression springs 127 are used as an example of an urging member. That is, the rollers 124 roll along the horizontal plate 114*c* and the inclined surfaces 120*b* in the axial direction of the driven roller 104. To be specific, due to the urging force of the compression spring 127, the rollers 124 roll along the horizontal plate 114*c* and the inclined surfaces 120*b* in the axial direction of the driven roller 104. As a result, the protrusions 122 of the holders 120 move in the oblong holes 115, and the driven roller 104 is moved in a radial direction of the driven roller 104. That is, an urging force in the axial direction of the driven roller 104 is converted into a force in the radial direction of the driven roller 104, so that a tension is applied to the transport belt 108 and a frictional force needed for correction of meandering of the transport belt 108 is generated. The rollers 124 and the inclined surfaces 120*b* convert the urging force in the axial direction of the driven roller 104 to a force in a direction toward the transport belt 108.

Third Exemplary Embodiment

Figure 9:
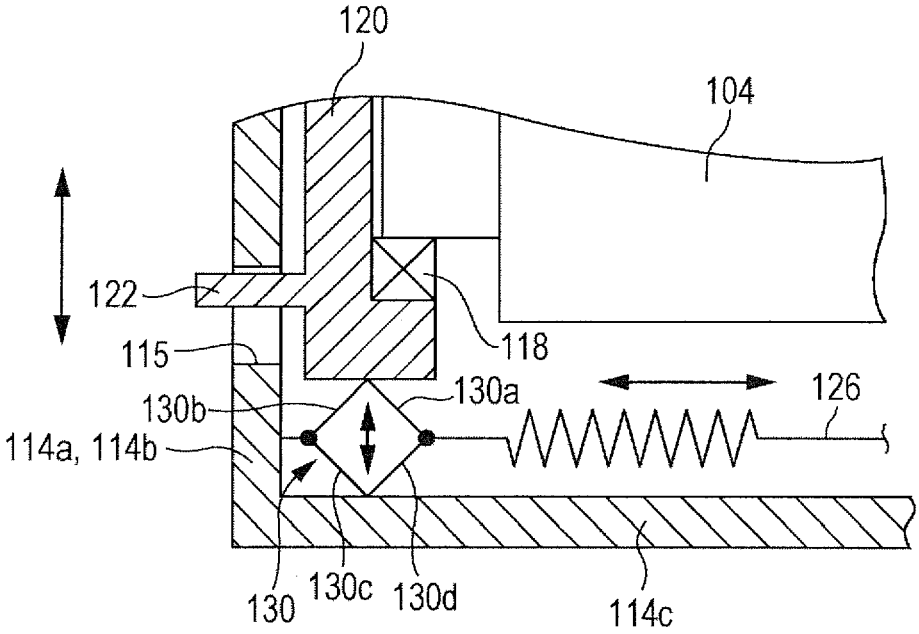
FIG. 9 illustrates a conversion unit according to a third exemplary embodiment of the present invention.

FIG. 9 illustrates a conversion unit used in a transport device 100 according to a third exemplary embodiment of the present invention.

In the first and second exemplary embodiments, the rollers 124 and the inclined surfaces 120*a* of the holders 120 are used. In the present exemplary embodiment, link mechanisms 130 each having four links are used.

The link mechanisms 130 each have a rhombus (pantograph-like) shape.

To be specific, each of the link mechanisms 130, which has two degree of freedom, includes a first link 130*a*, a second link 130*b*, a third link 130*c*, and a fourth link 130*d*. The first link 130*a* connects an end of the tension spring 126 to a side surface of the holder 120. The second link 130*b* connects an end of the first link 130*a* to a corresponding one of the side plates 114*a* and 114*b*. The third link 130*c* connects an end of the second link 130*b* to the horizontal plate 114*c*. The fourth link 130*d* connects an end of the third link 130*c* to the end of the tension spring 126. It is not necessary that a side surface of the holder 120 be an inclined surface. The side surface is substantially parallel to the horizontal plate 114*c*.

When a tensile force is applied to each of the tension springs 126 in a substantially horizontal direction, the driven roller 104 is moved toward the horizontal plate 114*c* (the drive roller 102). When a compressive force is applied to each of the tension springs 126 in a substantially horizontal direction, the driven roller 104 is moved away from the horizontal plate 114*c* (the drive roller 102). That is, when urging forces are applied to the tension springs 126 in the axial direction of the driven roller 104, due to the function of the link mechanisms 130, the protrusions 122 of the holders 120 move in the oblong holes 115 so as to move the driven roller 104 in a radial direction of the driven roller 104. That is, an urging force in the axial direction of the driven roller 104 is converted into a force in the radial direction of the driven roller 104 toward the transport belt 108, so that a tension is applied to the transport belt 108 and a frictional force needed for correction of meandering of the transport belt 108 is generated.

Fourth Exemplary Embodiment

Figure 10:
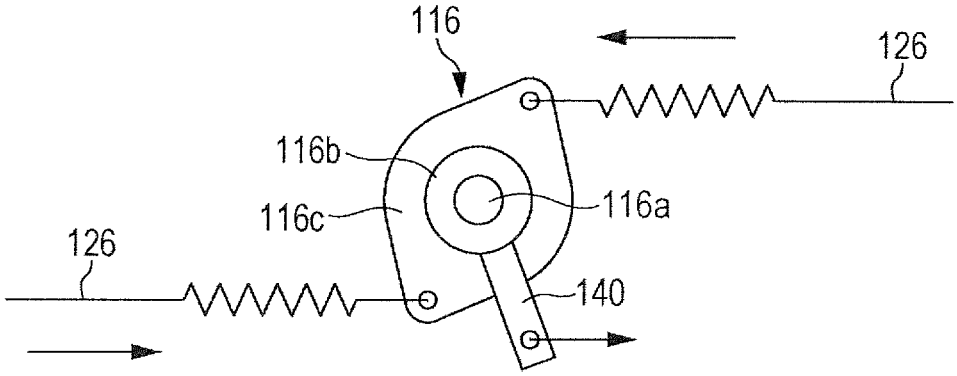
FIG. 10 illustrates an adjustment unit according to a fourth exemplary embodiment of the present invention.

FIG. 10 illustrates an adjustment unit used in a transport device 100 according to a fourth exemplary embodiment of the present invention.

In the transport device 100 according to first to third exemplary embodiments, the connection unit 116 and the adjuster 128, which meshes with grooves in the outer peripheral surface of the connection unit 116, are used as an adjustment unit. The adjuster 128 is not used in the present exemplary embodiment. Instead, the connection unit 116 has an arm 140. When the arm 140 moves leftward and rightward, the connection unit 116 is rotated leftward and rightward, the tensions (urging forces) of the tension springs 126 are adjusted, and a frictional force needed for correction of meandering of the transport belt 108 is generated. To be specific, the connection unit 116 is rotated by moving the arm 140. The tensions of the tension springs 126 may be decreased in order to facilitate replacement of the transport belt 108 and assembly of the transport device 100. On the other hand, the tensions of the tension springs 126 may be increased in order to facilitate attachment of the transport belt 108 and apply an appropriate tension to the transport belt 108.

The arm 140 is flexibly supported and prevents meandering of the transport belt 108. A motor 129 may be connected to the arm 140 so that the arm 140 may automatically perform adjustment in accordance with meandering of the belt.

The present invention is applicable to image forming apparatuses, such as copiers, printers, and facsimile machines.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A transport device comprising:

a belt-shaped member that is rotated so as to transport an object;

a first support member that supports the belt-shaped member, the first support member comprising two end parts;

an urging member extending in an axial direction of the first support member, the urging member simultaneously applying a force to both end parts of the first support member in a same direction that is different than the axial direction of the first support member;

a conversion unit that converts a direction of an urging force of the urging member to a direction toward the belt-shaped member;

a second support member that supports the belt-shaped member;

a first body that supports the first support member;

a second body that supports the second support member; and a connection unit that connects the first body to the second body in such a way that the first body and second body are rotatable relative to each other.

2. The transport device according to claim 1, further comprising:

an adjustment unit that adjusts the urging force of the urging member.

3. The transport device according to claim 2, wherein the connection unit is connected to the urging member, and the adjustment unit adjusts the urging force of the urging member by rotating the connection unit.

4. A fixing device comprising:

a belt-shaped member that is rotated;

a first support member that supports the belt-shaped member, the first support member comprising two end parts;

an urging member extending in an axial direction of the first support member, the urging member simultaneously applying a force to both end parts of the first support member in a same direction that is different than the axial direction of the first support member;

a conversion unit that converts a direction of an urging force of the urging member to a direction toward the belt-shaped member;

a heating member that supports the belt-shaped member in corporation with the first support member;

a pressing member that faces the heating member with the belt-shaped member therebetween;

a second support member that supports the belt-shaped member;

a first body that supports the first support member;

a second body that supports the second support member; and a connection unit that connects the first body to the second body in such a way that the first body and second body are rotatable relative to each other.

5. An image forming apparatus comprising:

a fixing device comprising:

a belt-shaped member that is rotated;

a first support member that supports the belt-shaped member, the first support member comprising two end parts;

an urging member extending in an axial direction of the first support member, the urging member simultaneously applying a force to both end parts of the first support member in a same direction that is different than the axial direction of the first support member;

a conversion unit that converts a direction of an urging force of the urging member to a direction toward the belt-shaped member;

a heating member that supports the belt-shaped member in corporation with the first support member;

a pressing member that faces the heating member with the belt-shaped member therebetween; and an image forming unit that forms an image on a recording medium onto which the fixing device is to fix the image;

a second support member that supports the belt-shaped member;

a first body that supports the first support member;

a second body that supports the second support member; and a connection unit that connects the first body to the second body in such a way that the first body and second body are rotatable relative to each other.

6. A transport device comprising:

a belt-shaped member that is rotated so as to transport an object;

a first support member that supports the belt-shaped member;

an urging member extending in an axial direction of the first support member;

a conversion unit that converts a direction of an urging force of the urging member to a direction toward the belt-shaped member;

a second support member that supports the belt-shaped member;

a first body that supports the first support member;

a second body that supports the second support member; and a connection unit that connects the first body to the second body in such a way that the first body and second body are rotatable relative to each other.

7. The transport device according to claim 6, further comprising:

an adjustment unit that adjusts the urging force of the urging member.

8. The transport device according to claim 7, wherein the connection unit is connected to the urging member, and the adjustment unit adjusts the urging force of the urging member by rotating the connection unit.

* * * * *